US008193732B2

(12) United States Patent
Ayala et al.

(10) Patent No.: US 8,193,732 B2
(45) Date of Patent: Jun. 5, 2012

(54) AUTOMATIC CALIBRATION OF AN AUTOMATED DIMMER

(75) Inventors: Vicente Humberto Aldape Ayala, Monterrey (MX); Ricardo Alejandro Lopez Guajardo, Monterrey (MX)

(73) Assignee: Intelliswitch, S.A. de C.V., Monterrey, Nuevo Leon, Cp (MX)

( * ) Notice: Subject to any disclaimer, the term of this patent is extended or adjusted under 35 U.S.C. 154(b) by 27 days.

(21) Appl. No.: 12/840,108

(22) Filed: Jul. 20, 2010

(65) Prior Publication Data

US 2011/0127928 A1 Jun. 2, 2011

Related U.S. Application Data

(63) Continuation-in-part of application No. 11/900,949, filed on Sep. 14, 2007, now Pat. No. 7,759,879.

(60) Provisional application No. 61/365,937, filed on Jul. 20, 2010.

(51) Int. Cl.
*H05B 37/02* (2006.01)

(52) U.S. Cl. ..... 315/291; 315/209 R; 315/307

(58) Field of Classification Search ..... 315/172, 315/173, 209 R, 224, 225, 246, 250, 252, 315/276, 291, 307, 312–315, 325, 361, 362, 315/DIG. 4

See application file for complete search history.

(56) References Cited

U.S. PATENT DOCUMENTS

| | | | | |
|---|---|---|---|---|
| 3,944,876 | A | 3/1976 | Helmuth | |
| 4,147,961 | A | 4/1979 | Elms | |
| 4,287,455 | A | 9/1981 | Drieu | |
| 4,379,237 | A | 4/1983 | Mosteller, Jr. | |
| 4,697,122 | A | 9/1987 | Hoffer | |
| 4,791,338 | A | 12/1988 | Dean et al. | |
| 4,950,963 | A | 8/1990 | Sievers | |
| 5,043,635 | A | 8/1991 | Talbott et al. | |
| 5,493,182 | A * | 2/1996 | Sowa et al. | 315/291 |
| 5,729,097 | A * | 3/1998 | Holzer | 315/307 |
| 5,962,988 | A * | 10/1999 | Nuckolls et al. | 315/291 |
| 6,046,550 | A | 4/2000 | Ference et al. | |
| 6,124,684 | A | 9/2000 | Sievers | |
| 6,147,462 | A | 11/2000 | Sing et al. | |
| 6,172,466 | B1 | 1/2001 | Ki et al. | |
| 6,188,181 | B1 | 2/2001 | Sihha et al. | |
| 6,329,767 | B1 * | 12/2001 | Sievers | 315/307 |
| 6,870,329 | B2 | 3/2005 | Krieger et al. | |
| 7,221,106 | B1 | 5/2007 | Nemir et al. | |
| 7,336,041 | B2 | 2/2008 | Ayala et al. | |
| 7,759,879 | B2 | 7/2010 | Ayala et al. | |

* cited by examiner

*Primary Examiner* — Jacob Y Choi
*Assistant Examiner* — Jimmy Vu
(74) *Attorney, Agent, or Firm* — Haynes and Boone, LLP; William B. Nash; Joe Mencher

(57) ABSTRACT

The present specification discloses a method and device for automatically calibrating a reference light level for an automated dimmer for electric lights, such as fluorescent lamps. An automatic dimmer, including an automatic calibration device, can be installed in series between an instant-start electronic ballast and a fluorescent lamp. An exemplary method for calibrating a lamp includes blocking or removing all ambient light, turning on the electric light, measuring the light output, and turning off the electric light.

4 Claims, 7 Drawing Sheets

AUTOMATIC CALIBRATION OF AN AUTOMATED DIMMER

CROSS REFERENCE TO RELATED APPLICATIONS

This application claims priority from and incorporates by reference U.S. Patent Application Ser. No. 61/365,937, entitled "Automatic Calibration of an Automated Dimmer", filed Jul. 20, 2010, and is a continuation-in-part of and incorporates by reference U.S. patent application Ser. No. 11/900,949, entitled "Automatic Light Dimmer for Electronic and Magnetic Ballasts (Fluorescent or HID)," filed Sep. 14, 2007, and issued as U.S. Pat. No. 7,759,879 on Jul. 20, 2010. The foregoing are incorporated herein by reference.

BACKGROUND

This specification relates to the field of electronic lighting, and more particularly to a device and method for automatically calibrating an automated electronic dimmer.

The parent patent application discloses an automatic dimmer for automatically adjusting the brightness of a lamp such as a fluorescent lamp to compensate for changes in ambient light conditions. In the prior art, the reference level for an automatic lamp may be set by a manual control such as rheostatic potentiometers, level switches, wired or wireless keyboards, slide controls, or other some similar manual means. Besides requiring manual input from a user, these systems also require extra wiring to facilitate the manual adjustment means.

SUMMARY OF THE INVENTION

In one aspect, the present specification discloses a method and device for automatically calibrating a reference light level for an automated dimmer for electric lights, such as fluorescent lamps. An automatic dimmer, including an automatic calibration device, can be installed in series between an instant-start electronic ballast and a fluorescent lamp. An exemplary method for calibrating a lamp includes blocking or removing all ambient light, turning on the electric light, measuring the light output, and turning off the electric light.

DETAILED DESCRIPTION OF THE EMBODIMENTS

To operate properly, an automatic dimmer such as that disclosed in the parent application must be calibrated to a reference illumination level representing an essentially zero ambient light condition. Ambient light may come, for example, from sunlight, from another lamp in the room, or from light coming in from a hallway. The device and method of the present specification provides automatic calibration of the lamp to the zero ambient light level. This eliminates the need for an end-user to manually set a reference level, which in some cases may require the user to find a suitable level by trial and error.

Figure 1:
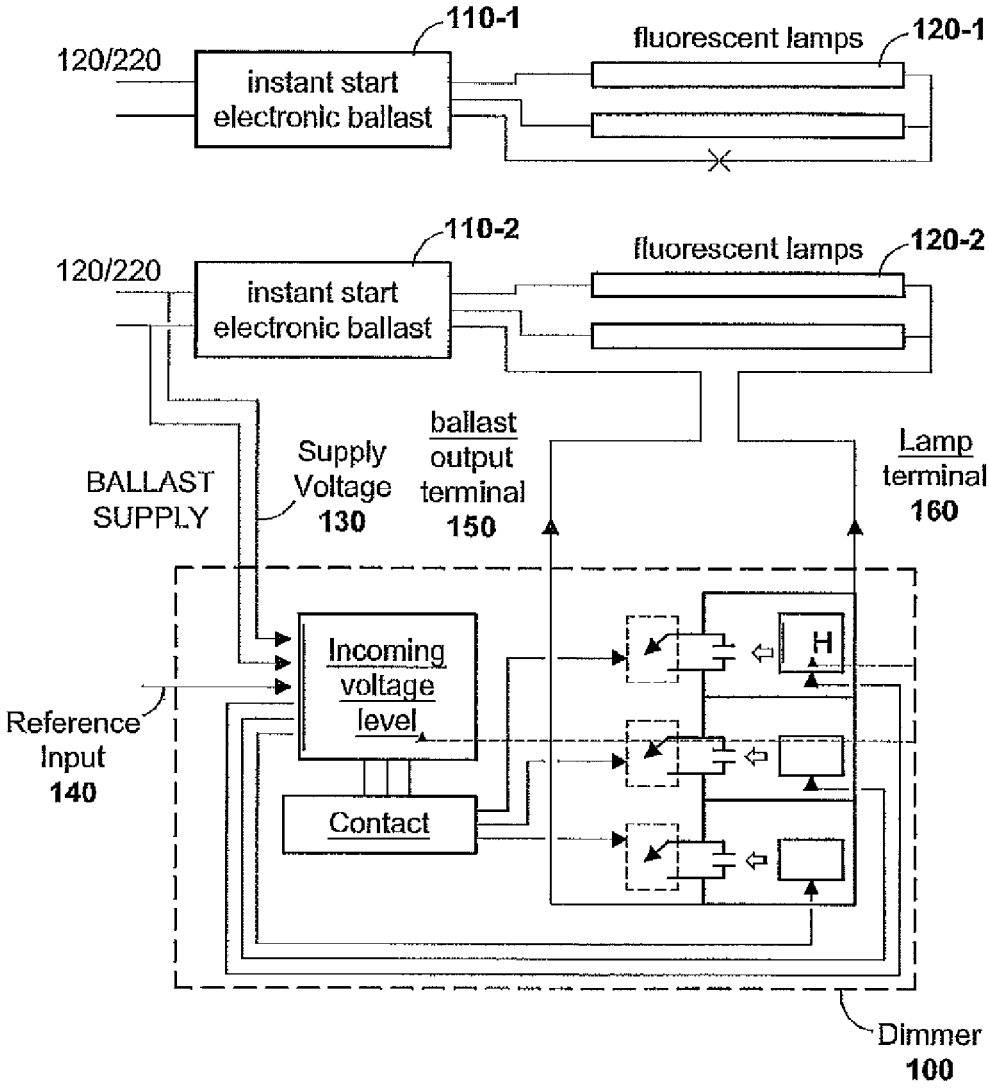
FIG. 1 is a block diagram of an automated dimmer of the parent application.

FIG. 1 discloses an exemplary embodiment of the system of the parent application. An instant start electronic ballast 110-1, which is known in the prior art, is provided to ensure that appropriate currents are provided to fluorescent lamps 120. Similarly, instant start electronic ballast 110-2 is connected to fluorescent lamps 120-2. An automatic dimmer 100 is connected in series between ballast 110-2 and lamps 120-2. Dimmer 100 has a reference input 140, which can be a manual reference input such as those known in the prior art. Supply voltage 130 is also provided to dimmer 100. Further, as disclosed in the parent application, dimmer 100 includes a light sensor for detecting the level of light output. According to the embodiment of FIG. 1, a user is required to manually set reference input 140, for example by turning a knob on a rheostatic potentiometer, inputting a reference level on an electronic keypad, using a sliding control, or other similar means known in the prior art. Dimmer 100 also requires supply voltage 130 and reference input 140 as connection points in addition to ballast output terminal 150 and lamp terminal 160, by which dimmer 100 is connected in series to the circuit.

Figure 2:
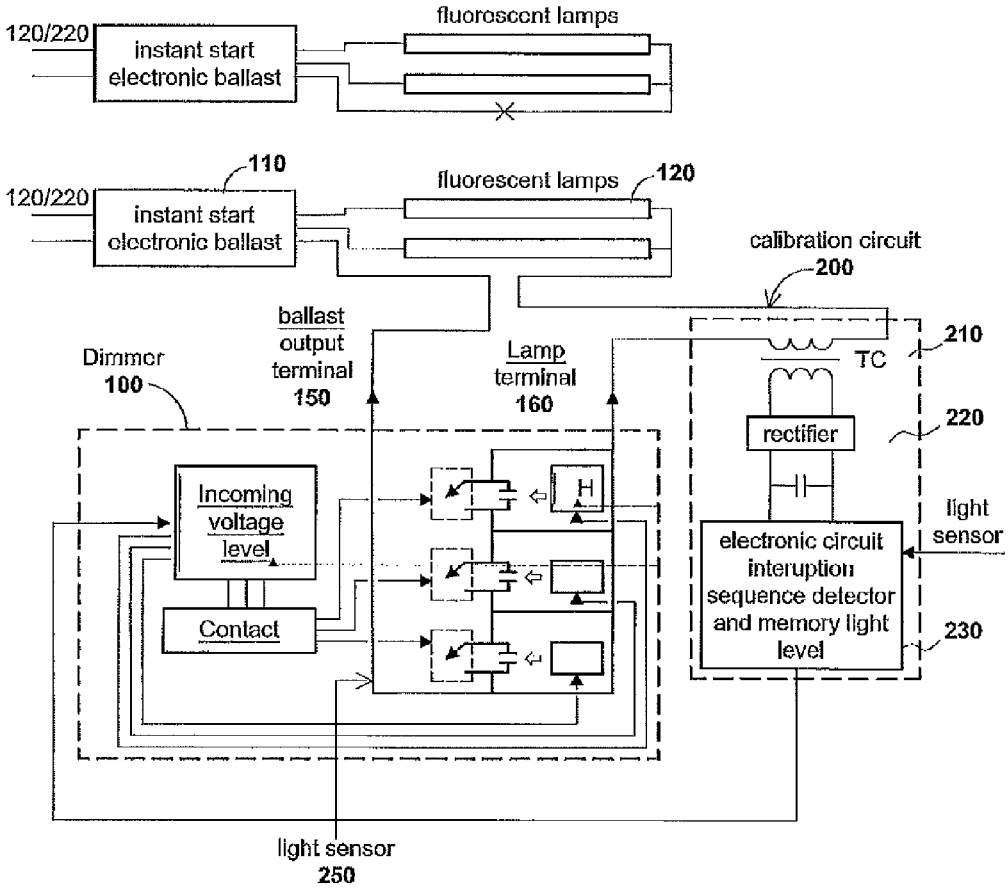
FIG. 2 is a block diagram of an automated dimmer, including an automatic calibration circuit.

FIG. 2 discloses an exemplary embodiment of the present disclosure. The embodiment of FIG. 2 also includes an instant-start electronic ballast 110, fluorescent lamps 120, and a dimmer 100. It in addition to the circuitry disclosed in the parent application, dimmer 100 includes a calibration circuit 200, which is provided for automatic calibration to a substantially zero ambient light level. Calibration circuit 200 includes a current transformer 210, a rectifier 220, which may be a capacitive rectifier, and a control circuit 230. Control circuit 230 may be one of several types of control circuits such as those known in the art. For example, control circuit 230 may be a central processing unit or other similar solid-state logic device such as an application-specific integrated circuit, programmable logical way, microcontroller, digital signal processor, or other similar programmable device. Control circuit 230 is configured to detect a calibration sequence and upon detection, measure the light output of the lamp, as received from the light sensor of dimmer 100.

Figure 3:
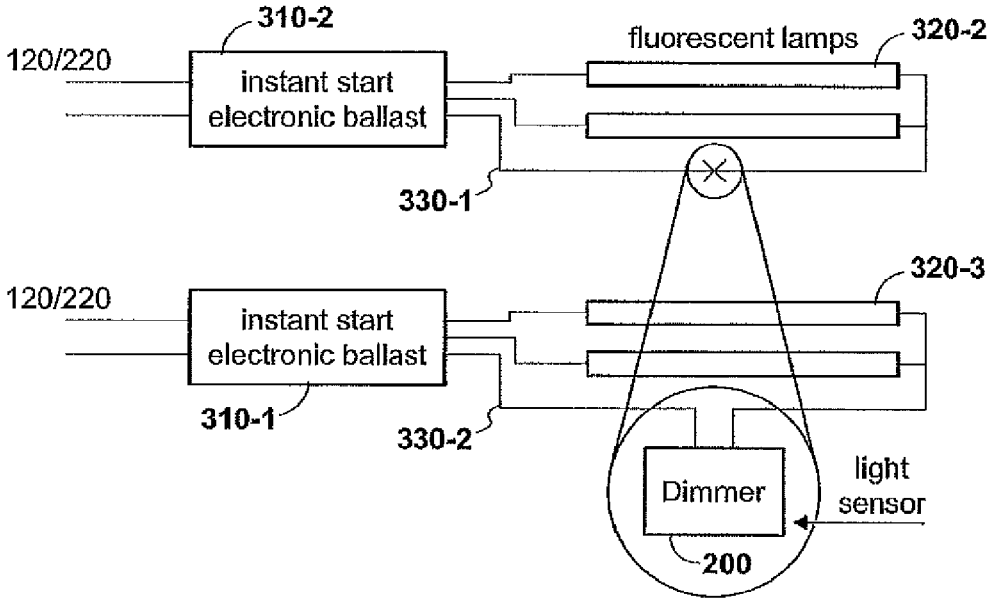
FIG. 3 is a block diagram of an in situ embodiment of the present invention.

FIG. 3 is a block diagram of the present invention installed in situ with a fluorescent lamp. As the figure discloses, installation require severing the ballast output terminal 150 and installing dimmer 100 in series, connecting the output terminal of dimmer 100 with newly-formed lamp terminal 160.

With an automatic calibration device thus installed, an automatic dimming system can be calibrated to its zero-ambient-light condition. In an exemplary embodiments, control circuit 230 may be programmed to provide following exemplary procedure:

a. Connect the automatic dimmer in series between an electronic ballast and one or more electric lights;
b. Removing ambient light sources, for example by covering windows and doors, or by performing the procedure at night;
c. Turn on power to the electric lights;
d. Wait a first time period for the automatic dimmer to provide a first indicator that the light source has been turned on. In an exemplary embodiment, the first time period is five seconds and the first indicator is an LED that blinks once approximately 5 seconds after the electric light is turned on. In an alternative embodiment, the indication may be provided by the user performing the calibration. For example, the user may time himself with a clock or stopwatch, to know when 5 seconds have passed.

e. Turn off the electric lights within a second time period. A second indicator may indicate that the electric light was turned off within the second time period. In an exemplary embodiment, the second time period is three seconds, and the second indicator is the LED blinking twice.

The preceding steps may be repeated a plurality of times to ensure a good calibration. For example, in one exemplary embodiment, the preceding steps may be performed a total of three times.

Figure 4:
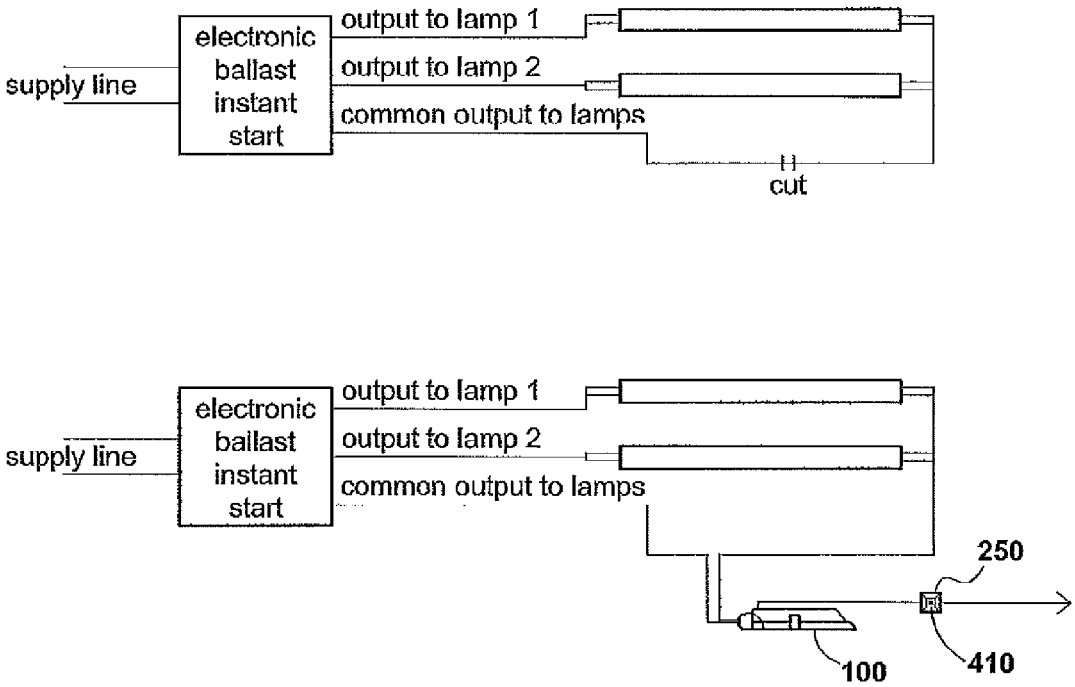
FIG. 4 is a block diagram of installation of the present invention with two electric lights.

FIG. 4 is a block diagram of an installation method of dimmer 100 with two lamps. This figure discloses the automatic dimmer 100 installed in series with a common output node for the two lamps. As this figure discloses, light sensor 250 should be installed in an orientation toward the nearest window. Status indicator for 10, which may be an LED is also shown, and may be useful in providing calibration related indications. For example, status indicator for 10 made link once after 5 seconds, indicating that the lamp is ready to be calibrated, and if power is removed within 3 seconds after the first indication, then status indicator for 10 made link once indicating that the calibration procedure has been successfully completed.

Figure 4A:
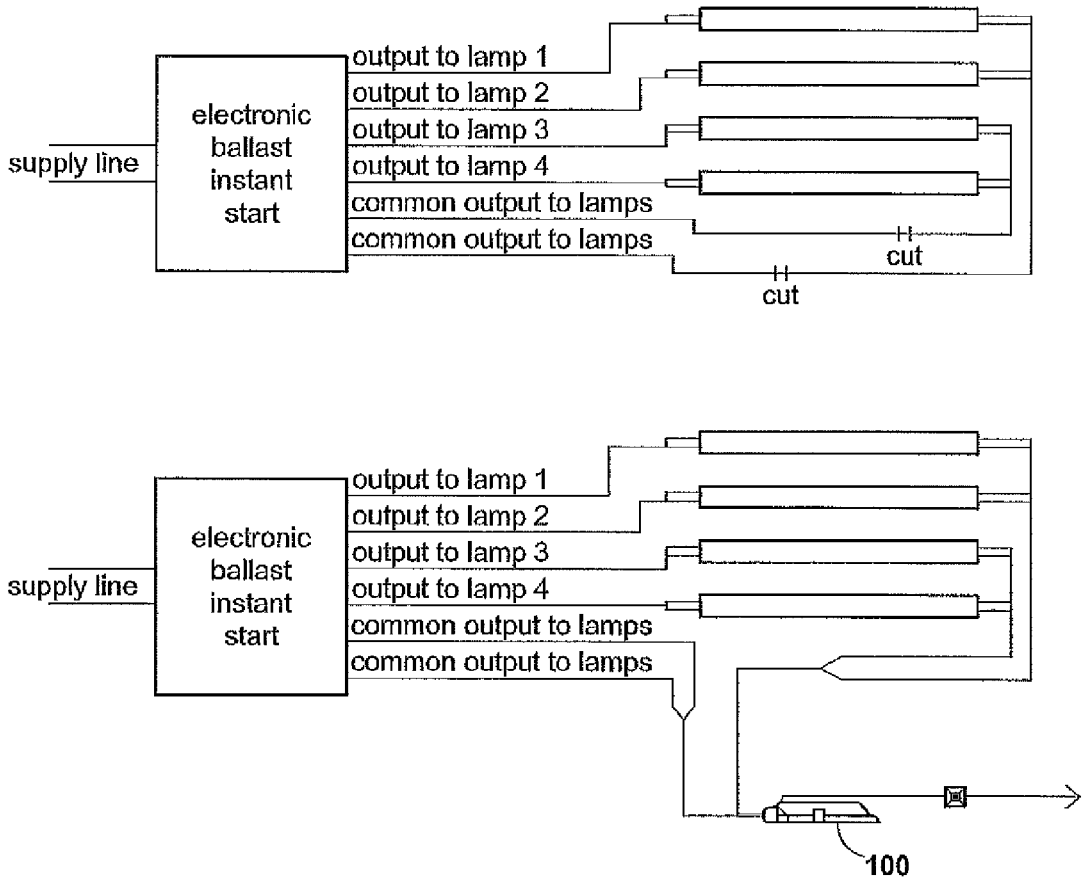
FIG. 4A is a block diagram of installation of the present invention with four electrical lights.

FIG. 4A is a block diagram of installation of the present invention for use with four electrical lights. In this example, two common output nodes are provided. As shown in this figure, in the case of two common output nodes, the common output lines may be shorted together on either end and connected directly to automatic dimmer 100.

Figure 5:
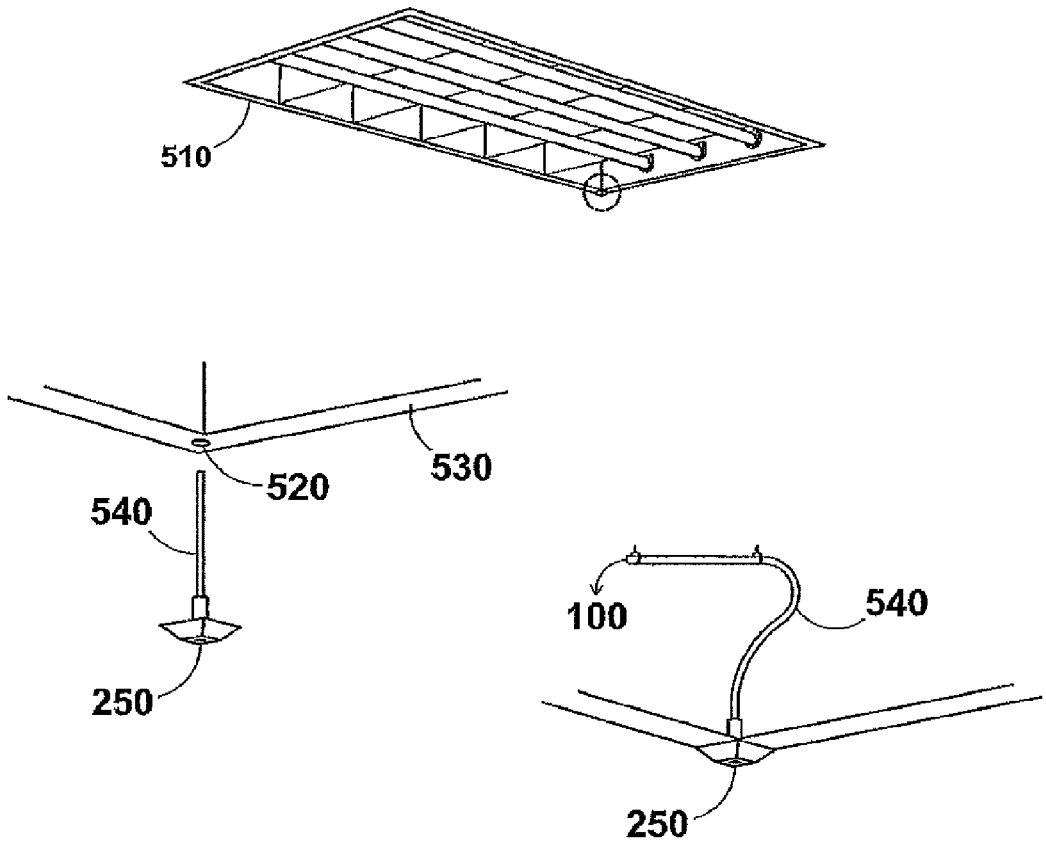
FIG. 5 is a perspective view of installation of the present invention, including orientation of the light sensor.

FIG. 5 is a perspective view of a method of installation of the present invention. A fluorescent lamp array 510 is shown, which is to be controlled by an automatic dimmer 100. Fluorescent lamp array 510 is bordered by a rim 530. In an exemplary installation method, a 5/16-inch hole 520 is drilled in rim 530. This allows passage of appropriate connecting wires up to automatic dimmer 100. As is shown in this drawing, light sensor 250 should be installed in an orientation toward the nearest window. Sensor cable 540 may then be connected to automatic dimmer 100.

Figure 6:
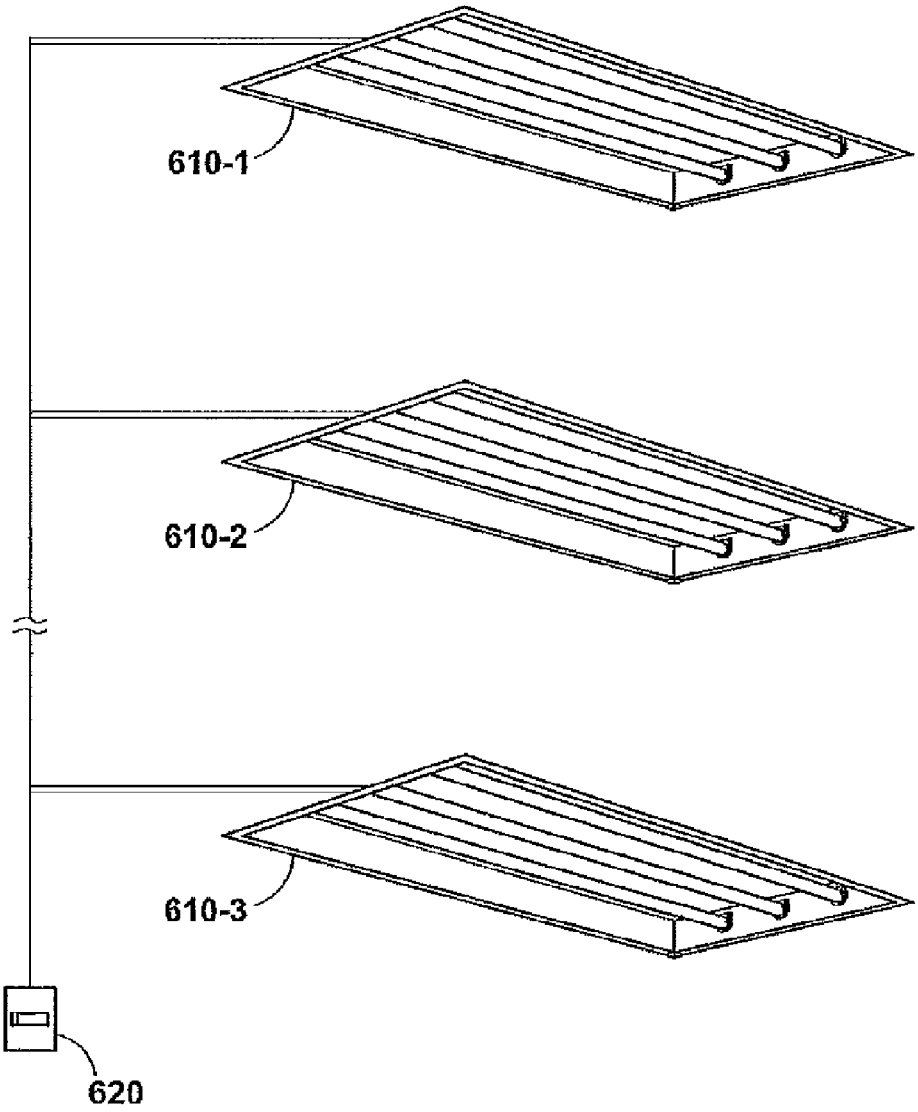
FIG. 6 is a perspective view of a plurality of fluorescent light arrays, each having an automatic calibration circuit installed therein.

FIG. 6 is a perspective view of a plurality of fluorescent light arrays 610, each having installed there in an automatic dimmer or 100 with an automatic calibration circuit 200. Fluorescent light arrays 610-1, 610-2, and 610-3, may represent different light arrays in a single office, or may represent a number of light arrays throughout an office space. As all of the fluorescent light arrays 610 are connected to a common line supply 620, they may all be calibrated together, rather than a user needing to individually calibrate each fluorescent light ray 610. As it may be difficult or time-consuming to artificially block ambient light sources for a plurality of fluorescent light arrays 610, the user may choose to perform this operation at night with all extra lights turned off. In this example, it may be useful for the user to time each step himself rather then relying on status indicator for 10. For example, the user may turn common line supply 622 and "on" position, thereby causing each fluorescent light array 610 to turn on substantially simultaneously with other fluorescent light arrays 610. The user may then waits a first time period, and after expiration of the first time period, turn common line supply to an "off" position. In an exemplary embodiment, the first time period is between three and 6 seconds, and is preferably either four or 5 seconds, and the second time period is between one and 4 seconds, and is preferably two or 3 seconds. Once the user has completed this calibration procedure, fluorescent light arrays 610-1, 610-2, and 610-3 are all calibrated to the appropriate light level.

While the subject of this specification has been described in connection with one or more exemplary embodiments, it is not intended to limit the claims to the particular forms set forth. On the contrary, the appended claims are intended to cover such alternatives, modifications and equivalents as may be included within their spirit and scope.

What is claimed is:

1. An automatic dimming system for causing an electric light to provide a preselected level of light, the electric light having a gradual light dimming characteristic, the automatic dimming system comprising: an electronic ballast; an automatic dimmer connected in series between the electronic ballast and electric light, the automatic dimmer comprising: a plurality of capacitors having a heating element that affects its capacitance thereby providing an electric current flow reduction to the electric light that allows the electric lights gradual light dimming characteristic to operate; switches to select between the capacitors so as to bury their equivalent capacitance, thereby providing an electric current flow reduction to the electric light that allows a gradual light dimming characteristic of the lamp to operate; and an automatic calibration circuit connected in series with the automatic dimmer, the automatic calibration circuit comprising: a light sensor; a current transformer; a rectifier; a control circuit configured to enter a calibration state, and upon entering the calibration state, receive a signal representing light level from the light sensor and to calibrate the output level of the dimmer in response to the light level.

2. The automatic dimming system of claim 1 wherein the light sensor is oriented toward the nearest window.

3. A plurality of electric light arrays, each electric light array having installed therein the automatic dimming system of claim 1, the electric light arrays all connected to a common electrical supply line.

4. The plurality of electric light arrays of claim 3 wherein the common electrical supply line has a single switch, whereby the plurality of electric light arrays can be calibrated simultaneously.

* * * * *